US010570626B1

(12) United States Patent
Kim

(10) Patent No.: US 10,570,626 B1
(45) Date of Patent: Feb. 25, 2020

(54) SUPPORT STRUCTURE FOR SUPPORTING FLOOR PANEL AND ACCESS FLOOR SYSTEM INCLUDING SUPPORT STRUCTURE

(71) Applicant: HAE KWANG CO., LTD., Chungcheongbuk-do (KR)

(72) Inventor: Myun Soo Kim, Gwacheon-si (KR)

(73) Assignee: HAE KWANG CO., LTD., Chungcheongbuk-Do (KR)

( * ) Notice: Subject to any disclaimer, the term of this patent is extended or adjusted under 35 U.S.C. 154(b) by 0 days.

(21) Appl. No.: 16/660,610

(22) Filed: Oct. 22, 2019

(30) Foreign Application Priority Data

Aug. 20, 2019 (KR) ..... 10-2019-0101938

(51) Int. Cl.
*E04F 15/024* (2006.01)

(52) U.S. Cl.
CPC .... *E04F 15/02458* (2013.01); *E04F 15/0247* (2013.01); *E04F 15/02452* (2013.01); *E04F 15/02464* (2013.01)

(58) Field of Classification Search
CPC ..... E04F 15/02452; E04F 15/02458; E04F 15/02464; E04F 15/0247; H02G 3/285; H02G 3/385
USPC ..... 52/126.5, 126.6, 263
See application file for complete search history.

(56) References Cited

U.S. PATENT DOCUMENTS 3,180,460 A * 4/1965 Liskey, Jr. ..... E04F 15/02405 52/479
4,630,417 A * 12/1986 Collier ..... F24F 7/10 52/263
5,477,649 A * 12/1995 Bessert ..... H02G 3/285 174/486
5,791,096 A * 8/1998 Chen ..... E04F 15/02458 52/126.6
10,047,528 B1 * 8/2018 Kim ..... E04F 15/02458

FOREIGN PATENT DOCUMENTS

DE 10100399 A1 * 7/2002 ..... E04B 5/14

* cited by examiner

*Primary Examiner* — Robert Canfield
(74) *Attorney, Agent, or Firm* — Maschoff Brennan

(57) ABSTRACT

Disclosed is a support structure on which a floor panel is seated. The support structure includes: a first beam element disposed in a first direction; a second beam element disposed in a second direction perpendicular to the first direction; a post supporting the first beam element and the second beam element; a beam element bracket seated on top of the first beam element and the second beam element, and connecting the first beam element and the second beam element to each other; and a pedestal seated on top of the beam element bracket, and supporting the floor panel.

17 Claims, 12 Drawing Sheets

SUPPORT STRUCTURE FOR SUPPORTING FLOOR PANEL AND ACCESS FLOOR SYSTEM INCLUDING SUPPORT STRUCTURE

CROSS REFERENCE TO RELATED APPLICATION

The present application claims priority to Korean Patent Application No. 10-2019-0101938, filed Aug. 20, 2019, the entire contents of which is incorporated herein for all purposes by this reference.

BACKGROUND OF THE INVENTION

Field of the Invention

The present invention relates generally to a support structure. More particularly, the present invention relates to a support structure for supporting a floor panel in an access floor system, and an access floor system including the support structure.

Description of the Related Art

An access floor system is a system for forming a floor spaced apart from a foundation floor by a predetermined distance. The access floor system includes floor panels disposed spaced apart from the foundation floor by a predetermined distance and a support structure supporting the floor panels from the foundation floor.

The access floor system is used in clean rooms such as semiconductor fabrication labs for fabrication of semiconductors requiring high precision and integration, pharmaceutical labs, genetic engineering labs, and the like. Various equipment or piping can be installed in the space between the floor panels and the foundation floor.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and an objective of the present invention is to provide a support structure including a pedestal so as to easily adjust a distance between a floor panel and a foundation floor in an access floor system, and an access floor system including the support structure.

In order to achieve the above objective, according to one aspect of the present invention, there is provided a support structure on which a floor panel is seated, and including: a first beam element disposed in a first direction; a second beam element disposed in a second direction perpendicular to the first direction; a post supporting the first beam element and the second beam element; a beam element bracket seated on top of the first beam element and the second beam element, and connecting the first beam element and the second beam element to each other; and a pedestal seated on top of the beam element bracket, and supporting the floor panel.

According to another aspect of the present invention, there is provided an access floor system, including: a floor panel; and a support structure supporting the floor panel, wherein the floor panel includes multiple unit panels, and the support structure includes: a first beam element disposed in a first direction; a second beam element disposed in a second direction perpendicular to the first direction; a post supporting the first beam element and the second beam element; a beam element bracket seated on top of the first beam element and the second beam element, and connecting the first beam element and the second beam element to each other; and a pedestal seated on top of the beam element bracket and supporting the unit panels.

Due to the fact that the support structure according to the embodiments of the present invention includes the pedestal that is height-adjustable, there is an advantage of efficiently adjusting the distance between the support structure and the floor panel.

Furthermore, according to the embodiments of the present invention, due to the fact that the pedestal and the beam element bracket are coupled to the beam elements using the pedestal connection portion, there is an advantage in that the support structure is increased in stability.

Furthermore, according to the embodiments of the present invention, due to the fact that the pedestal connection portion is inserted into the slide groove formed in each of the beam elements, there is an advantage in that the pedestal is easy to mount without requiring provision of separate threads formed on the beam elements, thus simplifying a manufacturing process.

BRIEF DESCRIPTION OF THE DRAWINGS

The above and other objectives, features and other advantages of the present invention will be more clearly understood from the following detailed description when taken in conjunction with the accompanying drawings, in which.

DETAILED DESCRIPTION OF THE INVENTION

Figure 1:
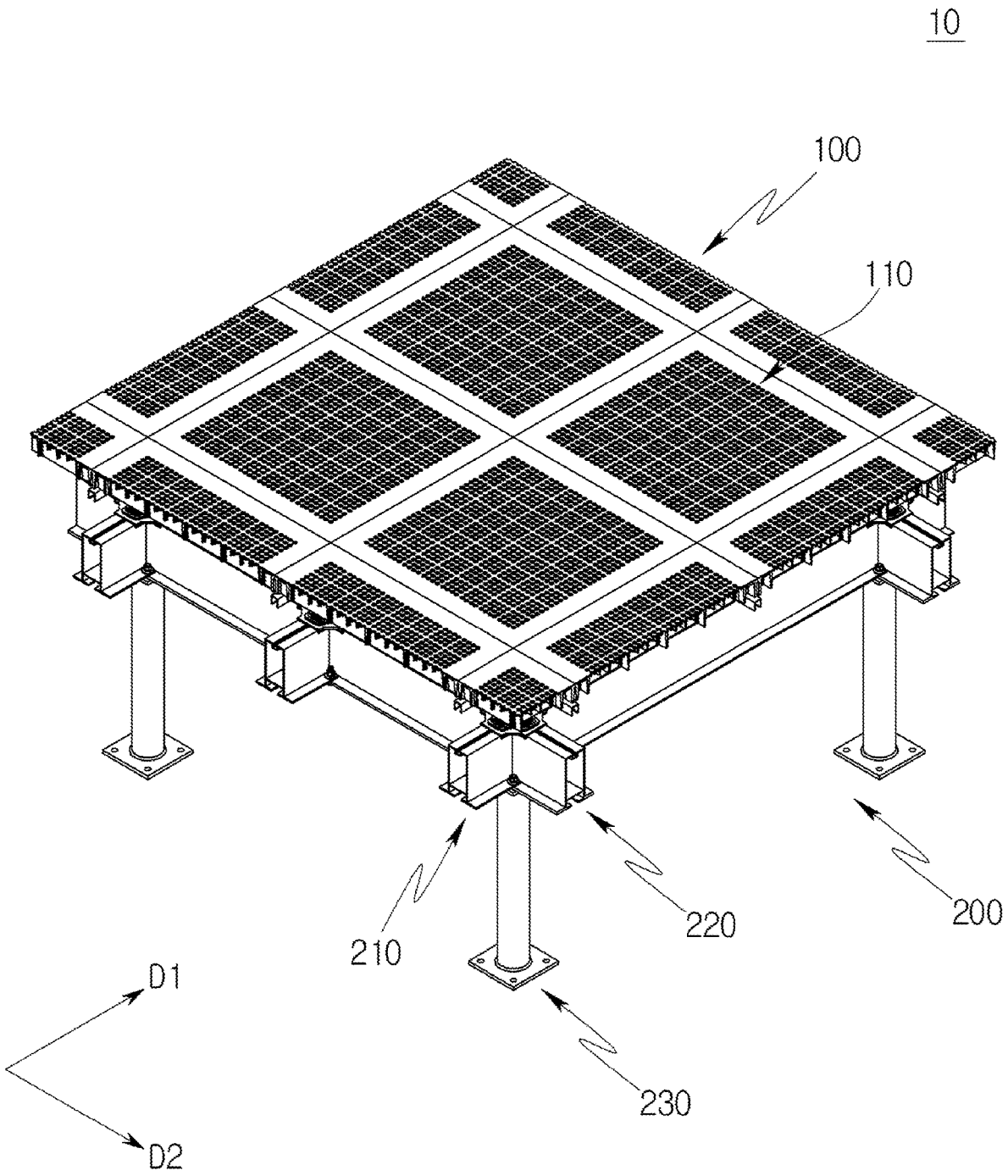
FIG. 1 is a view showing an access floor system according to embodiments of the present invention.

Hereinbelow, exemplary embodiments of the present invention will be described in detail with reference to the accompanying drawings. Throughout the drawings, the same reference numerals will refer to the same or like parts.

FIG. 1 is a view showing an access floor system according to embodiments of the present invention. Referring to FIG. 1, the access floor system 10 includes a floor panel 100 and a support structure 200. The floor panel 100 may refer to a flooring material used in a clean room or a computer room.

The floor panel 100 is installed at a predetermined distance from a foundation floor by the support structure 200 as will be described later.

In some embodiments, the floor panel 100 may include multiple unit panels 110, and the multiple unit panels 110 may be arranged on the support structure 200 in a grid arrangement to form an access floor.

The support structure 200 supports the floor panel 100 seated on the support structure 200. The support structure 200 is installed on the foundation floor to maintain the floor panel 100 spaced apart from the foundation floor by a predetermined distance. For example, the predetermined distance may exceed the length of one side of each of the unit panels 110 of the floor panel 100.

The support structure 200 includes first beam elements 210, second beam elements 220, and a post 230.

The first beam elements 210 are arranged to form a first beam element array, and the second beam elements 220 are arranged to form a second beam element array. The first beam elements 210 and the second beam elements 220 are coupled to each other in a perpendicular arrangement. In some embodiments, multiple first beam element arrays may be arranged spaced apart and parallel to each other in first directions D1, and multiple second beam element arrays may be arranged spaced apart and parallel to each other in second directions D2. The first directions D1 and the second directions D2 may be perpendicular to each other. Herein, an arrangement interval of the first beam element arrays and an arrangement interval of the second beam element arrays may correspond to the length (or width) of each of the unit panels 110 of the floor panel 100.

The first beam elements 210 and the second beam elements 220 have the same height. For example, upper surfaces of the first beam elements 210 and upper surfaces of the second beam elements 220 may be included in the same plane.

The first beam elements 210 and the second beam elements 220 are manufactured by an aluminum extrusion method. Such a method has an advantage in that there is less limitation on a cross-sectional shape of the first beam elements 210 and the second beam elements 220, and thus the beam elements 210 and 220 are reduced in weight and are easy to manufacture.

In some embodiments, each of the first beam elements 210 and the second beam elements 220 may be formed into a hollow body having a rectangular cross-section, but is not limited thereto. For example, each of the first beam elements 210 and the second beam elements 220 may be formed into shape steel such as H-steel, L-steel, shape steel having a polygonal cross-section, and the like.

The post 230 is coupled to the first beam elements 210 and the second beam elements 220 to support the first beam elements 210 and the second beam elements 220. In some embodiments, the post 230 may support the first beam elements 210 and the second beam elements 220 at a location under an intersecting portion of the first beam elements 210 and the second beam elements 220.

In some embodiments, the post 230 may be manufactured such that the height thereof corresponds to the design height of the floor panel 100.

Figure 2:
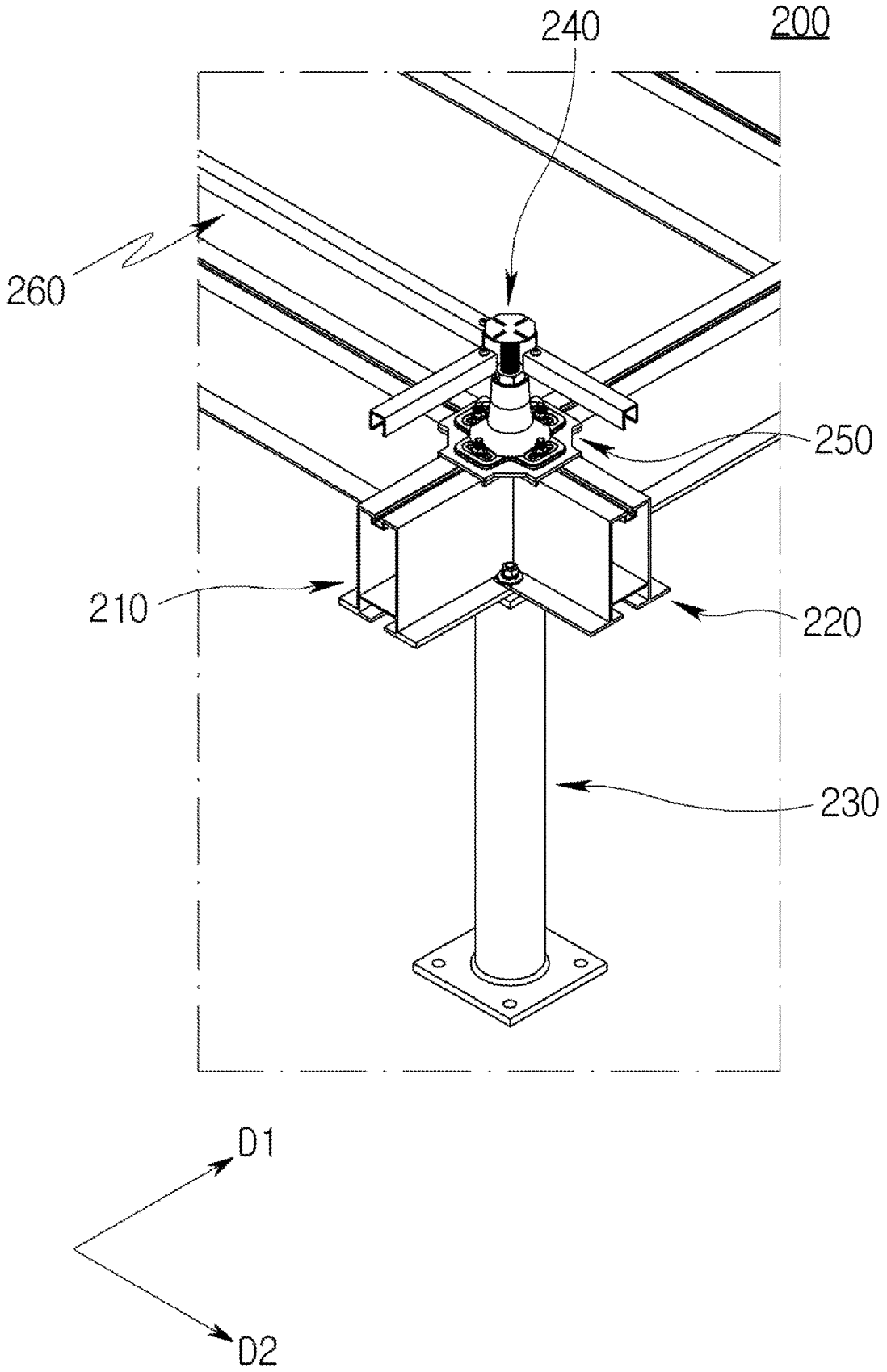
FIG. 2 is a perspective view showing a support structure according to embodiments of the present invention.

FIG. 2 is a perspective view showing a support structure according to embodiments of the present invention. FIG. 2 shows the support structure 200, with the floor panel 100 removed. Referring to FIGS. 1 and 2, the support structure 200 further includes a pedestal 240, a beam element bracket 250, and stringers 260.

The pedestal 240 is seated on the beam element bracket 250 and supports the floor panel 100. In some embodiments, the floor panel 100 may be seated on the pedestal 240. For example, when the unit panels 110 of the floor panel 100 are arranged in a grid arrangement, the pedestal 240 may support an intersecting point of the unit panels 110. That is, four unit panels 110 neighboring each other may be seated on one pedestal 240.

The pedestal 240 is configured to be height-adjustable, such that the level of the floor panel 100 is adjusted.

The beam element bracket 250 connects the first beam elements 210 and the second beam elements 220 to each other. In some embodiments, the beam element bracket 250 may be seated on the first beam elements 210 and the second beam elements 220 to connect and fix the first beam elements 210 and the second beam elements 220 to each other. For example, the beam element bracket 250 may be seated on an upper surface of the intersecting portion of the first beam elements 210 and the second beam elements 220.

According to embodiments of the present invention, provision of the beam element bracket 250 has an advantage of reducing deformation between the first beam elements 210 and the second beam elements 220, while improving coupling between the first beam elements 210 and the second beam elements 220.

The stringers 260 are connected to the pedestal 240 to support the floor panel 100 together with the pedestal 240, thus reinforcing a horizontal support force of the pedestal 240. In some embodiments, the stringers 260 may extend in the same direction as the first beam elements 210 (i.e., a first direction D1) and in the same direction as the second beam elements 220 (i.e., a second direction D2), and the floor panel 100 may be disposed on the stringers 260.

The stringers 260 connect and fix neighboring pedestals 240 to each other, thus reinforcing the horizontal support force of the pedestal 240.

Figure 3:
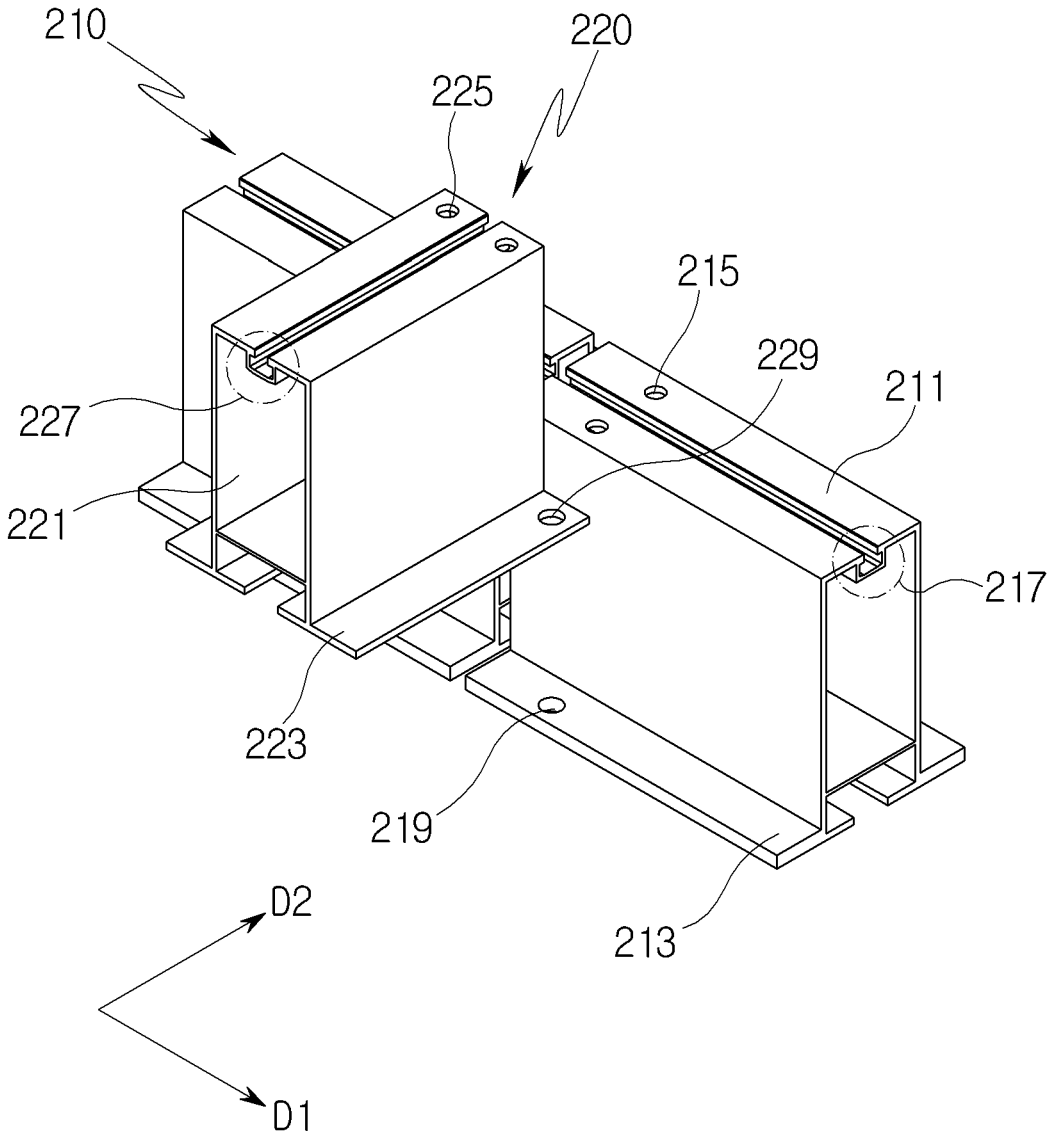
FIG. 3 is a view showing beam elements according to embodiments of the present invention.

FIG. 3 is a view showing beam elements according to embodiments of the present invention. Referring to FIGS. 1 to 3, each of the first beam elements 210 includes a first body portion 211 and a first wing 213, and each of the second beam elements 220 includes a second body portion 221 and a second wing 223.

The first body portion 211 includes a first upper hole 215 and a first slide groove 217. In some embodiments, the first upper hole 215 and the first slide groove 217 may be formed in an upper surface of the first body portion 211.

The first upper hole 215 may be provided as multiple first upper holes 215, and the multiple first upper holes 215 may be symmetrically arranged with respect to the first slide groove 217. For example, when two first upper holes 215 are provided in the first body portion 211, one of the two first upper holes 215 and a remaining one may be arranged symmetrical to each other with respect to the first slide groove 217.

The first slide groove 217 is formed to extend in an extending direction of the first beam element 210. In some embodiments, the first slide groove 217 may have a "T" shape, but is not limited thereto.

The first wing 213 extends from each lower end of the first body portion 211 and supports the first body portion 211 at the lower end of the first body portion 211. In some embodiments, the respective first wings 213 may extend oppositely outward from the first body portion 211 along a width direction of the first body portion 211.

Each of the first wings 213 includes a first lower hole 219. The first lower hole 219 is formed in the first wing 213. In some embodiments, multiple first lower holes 219 may be provided in the first wings 213, and the multiple first lower holes 219 may be symmetrically arranged with respect to the first body portion 211. For example, when two first lower holes 219 are provided in the respective first wings 213, one of the two first lower holes 219 and a remaining one may be arranged symmetrical to each other with respect to the first body portion 211.

The second body portion 221 includes a second upper hole 225 and a second slide groove 227. In some embodiments, the second upper hole 225 and the second slide groove 227 may be formed in an upper surface of the second body portion 221.

The second upper hole 225 may be provided as multiple second upper holes 225, and the multiple second upper holes 225 may be symmetrically arranged with respect to the second slide groove 227. For example, when two second upper holes 225 are provided in the second body portion 221, one of the two second upper holes 225 and a remaining one may be arranged symmetrical to each other with respect to the second slide groove 227.

The second slide groove 227 is formed to extend in an extending direction of the second beam element 220. In some embodiments, the second slide groove 227 may have a "T" shape, but is not limited thereto.

The second wing 223 extends from each lower end of the second body portion 221 and supports the second body portion 221 at the lower end of the second body portion 221. In some embodiments, the respective second wings 223 may extend oppositely outward from the second body portion 221 along a width direction of the second body portion 221.

Each of the second wings 223 includes a second lower hole 229. The second lower hole 229 is formed in the second wing 223. In some embodiments, multiple second lower holes 229 may be provided in the second wings 223, and the multiple second lower holes 229 may be symmetrically arranged with respect to the second body portion 221. For example, when two second lower holes 229 are provided in the respective second wings 223, one of the two second lower holes 229 and a remaining one may be arranged symmetrical to each other with respect to the second body portion 221.

The first beam elements 210 and the second beam elements 220 are coupled to each other through the lower holes 219 and 229. In some embodiments, the second wings 223 of the second beam elements 220 are seated on the first wings 213 of the first beam elements 210 with respect to the first lower holes 219 and the second lower holes 229, and beam element connecting members are coupled to the post 230 by passing through the first lower holes 219 and the second lower holes 229, whereby the first beam elements 210 and the second beam elements 220 are coupled to each other.

Figure 4:
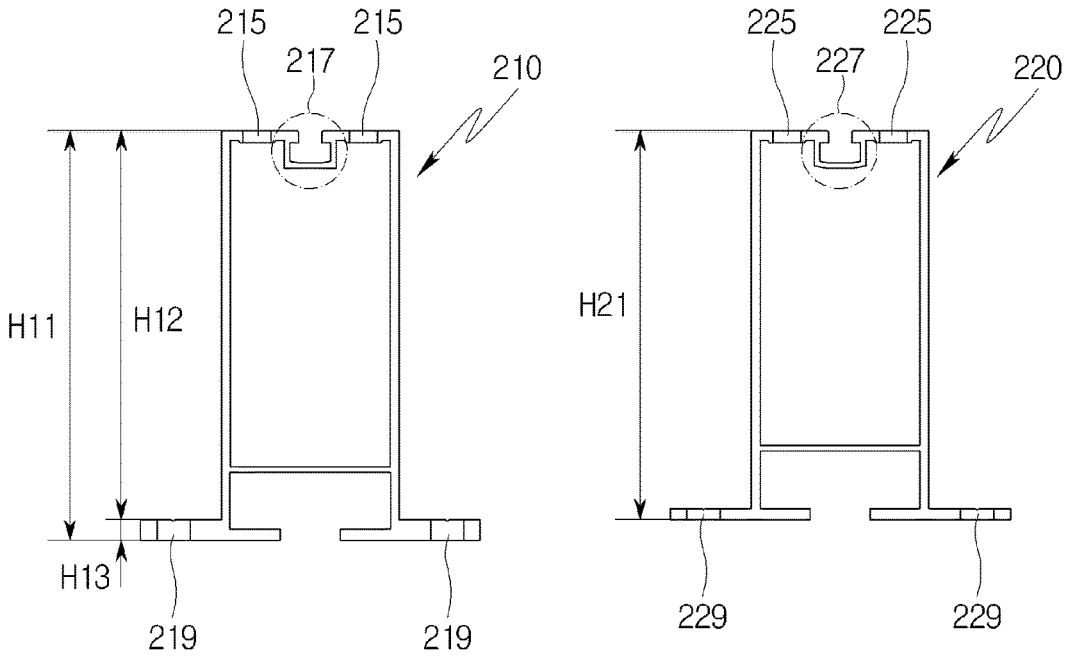
FIG. 4 is a view showing cross-sections of the beam elements according to embodiments of the present invention.

FIG. 4 is a view showing cross-sections of the beam elements according to embodiments of the present invention. Referring to FIGS. 1 to 4, due to the fact that the first beam elements 210 and the second beam elements 220 are coupled to each other, with the second wings 223 of the second beam elements 220 seated on the first wings 213 of the first beam elements 210, each of the first beam elements 210 may have a height H11 greater than a height H21 of each of the second beam elements 220.

In some embodiments, the height H11 of each of the first beam elements 210 may be equal to the sum of a height H12 of the first body portion 211 and a height H13 of the first wing 213, and the height H21 of each of the second beam elements 220 may be equal to the height H12 of the first body portion 211 of the first beam element 210. Accordingly, even when the second beam elements 220 are seated on and coupled to the first beam elements 210, the upper surfaces of the first beam elements 210 and the upper surfaces of the second beam elements 220 are included in the same plane. This therefore has an advantage in that the level of the floor panel 100 is maintained.

Figure 5:
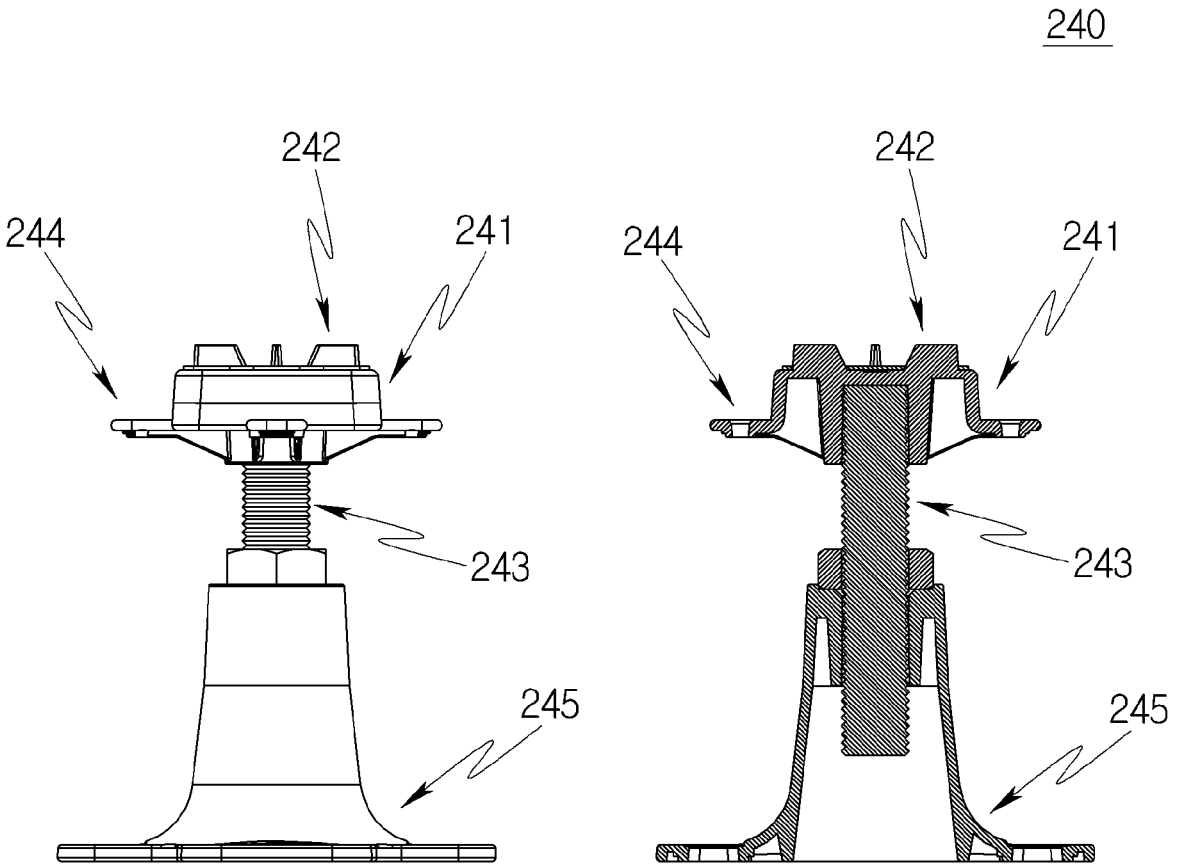
FIG. 5 is a view showing a pedestal according to embodiments of the present invention.
Figure 6:
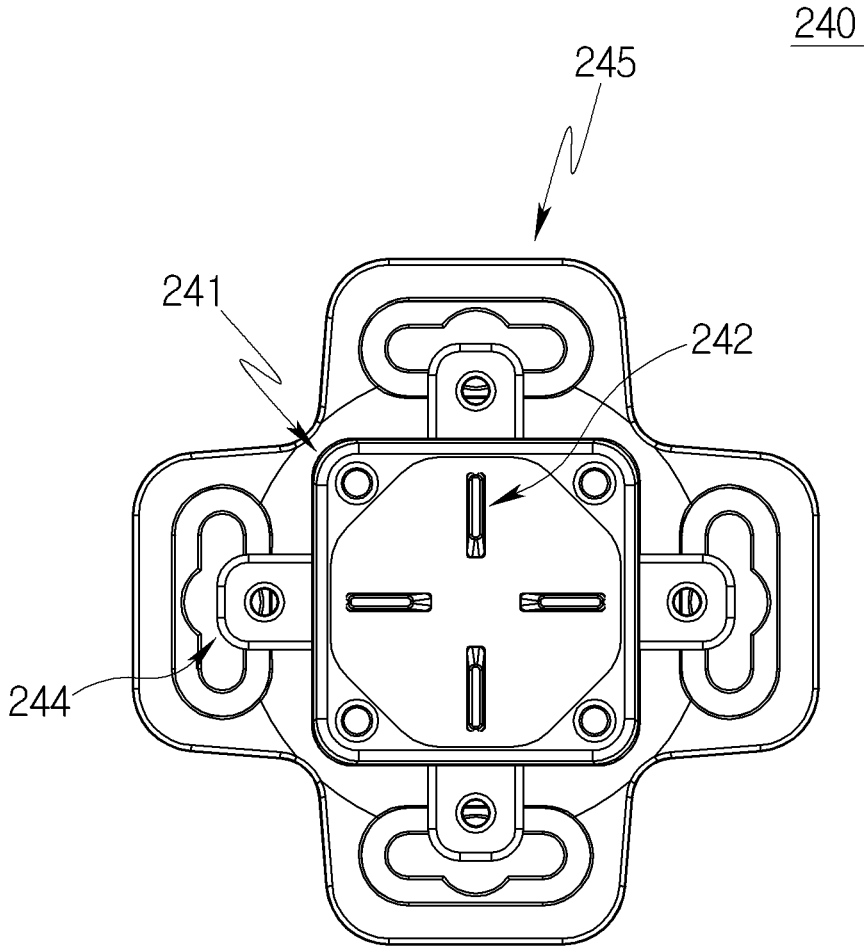
FIG. 6 is a view showing an upper surface of the pedestal according to embodiments of the present invention.

FIG. 5 is a view showing a pedestal according to embodiments of the present invention, and FIG. 6 is a view showing an upper surface of the pedestal according to embodiments of the present invention. Referring to FIGS. 1 to 6, the pedestal 240 includes a head portion 241, a connection portion 243, and a base portion 245.

The head portion 241 is disposed on top of the pedestal 240 to support the floor panel 100. In some embodiments, seat guide portions 242 may be provided on the head portion 241 to divide an area where the unit panels 110 of the floor panel 100 are seated.

The seat guide portions 242 are provided on the head portion 241 in cross directions to divide an upper surface of the head portion 241 into four sections, and the unit panels 110 are seated in the respective four sections. For example, the seat guide portions 242 may protrude from the upper surface of the head portion 241 by a predetermined thickness, and the unit panels 110 of the floor panel 100 may be arranged between the protruding seat guide portions 242.

In some embodiments, the head portion 241 may include stringer connection portions 244 for connecting the stringers 260 and the pedestal 240 to each other. In some embodiments, the stringers 260 may be connected to the pedestal 240 through the stringer connection portions 244. For example, the stringer connection portions 244 may extend from the head portion 241 in the first direction D1 and the second direction D2.

The connection portion 243 connects the head portion 241 and the base portion 245 to each other. In some embodiments, the connection portion 243 may be inserted into the head portion 241 and the base portion 245 and may be height-adjustable. For example, the connection portion 243 may include a bolt inserted into the head portion 241 and the base portion 245, and a nut coupled to the bolt.

The base portion 245 supports the pedestal 240. In some embodiments, the base portion 245 may be seated on the beam element bracket 250 to support the pedestal 240.

Figure 7:
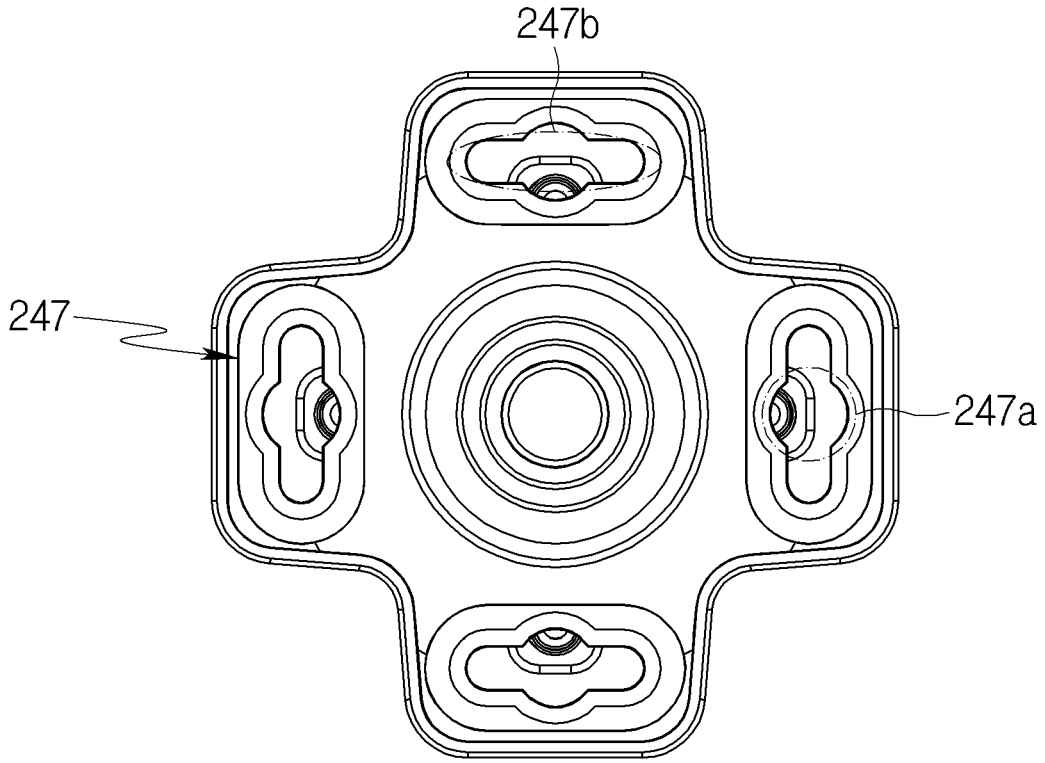
FIG. 7 is a view showing a base portion according to embodiments of the present invention.

FIG. 7 is a view showing a base portion according to embodiments of the present invention. Referring to FIGS. 1 to 7, multiple first receiving holes 247 are formed in the base portion 245. As will be described later, the base portion 245 of the pedestal 240 and the beam element bracket 250 are connected to each other through the first receiving holes 247. In some embodiments, four first receiving holes 247 may be formed in the base portion 245.

Longitudinal directions (i.e., directions having the longest length) of the first receiving holes 247 may be perpendicular to the extending directions of the beam elements 210 and 220 where the first receiving holes 247 are located. For example, the longitudinal directions of the first receiving holes 247 located over the first beam elements 210 may be perpendicular to the extending direction of the first beam elements 210 (i.e., the first direction D1). When the four first receiving holes 247 are formed in the base portion 245, two first receiving holes may be arranged in one base portion 245 along the first directions D1, and remaining two first receiving holes may be arranged along the second directions D2.

Each of the first receiving holes 247 has a first circular portion 247*a* and a first elliptical portion 247*b*. The first circular portion 247*a* has a circular shape, and the first elliptical portion 247*b* has an elliptical shape. In some embodiments, the first circular portion 247*a* and the first elliptical portion 247*b* may be concentrically formed.

Figure 8:
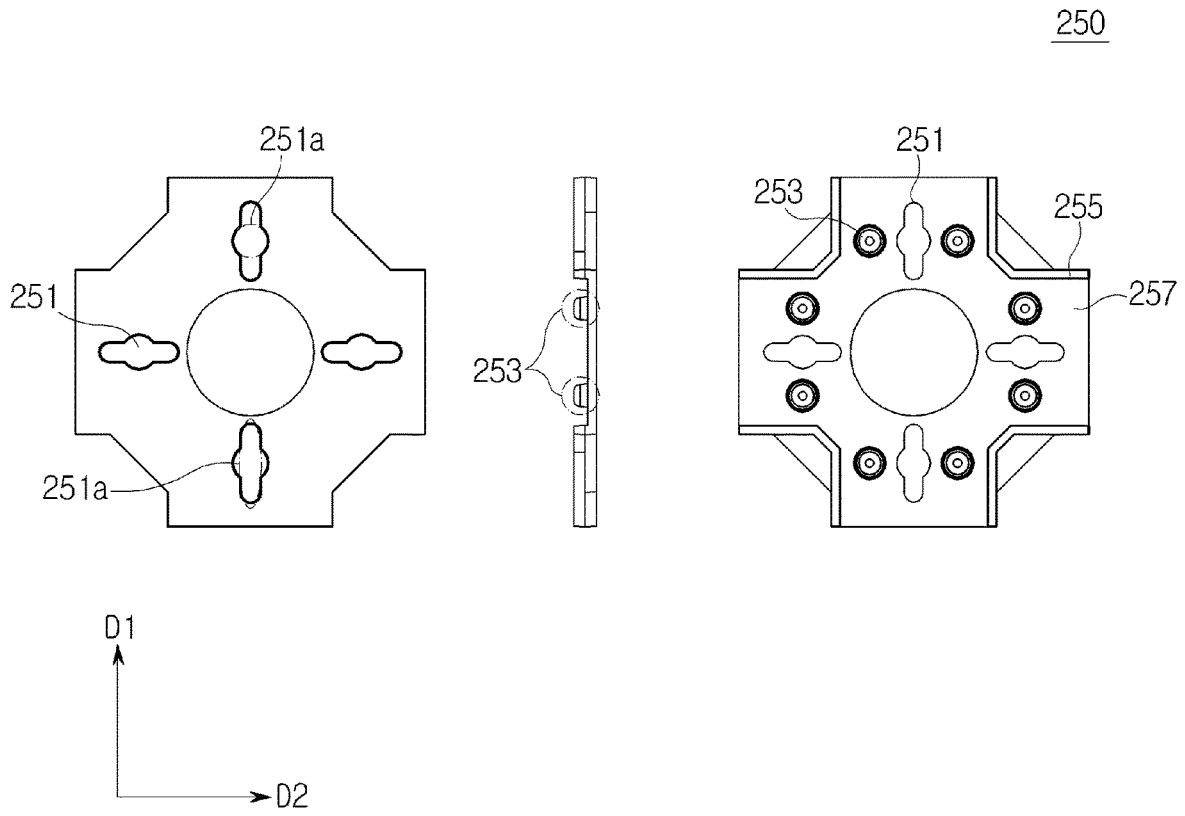
FIG. 8 is a view showing a beam element bracket according to embodiments of the present invention.

FIG. 8 is a view showing a beam element bracket according to embodiments of the present invention. FIG. 8 sequentially shows upper, side, and lower surfaces of the beam element bracket 250. Referring to FIGS. 1 to 8, the beam element bracket 250 includes multiple second receiving holes 251, a coupling pin 253, and a seat portion 255.

As will be described later, the second receiving holes 251 are used to couple the pedestal 240 and the beam element bracket 250 to each other. In some embodiments, four second receiving holes 251 may be provided.

Longitudinal directions (i.e., directions having the longest length) of the second receiving holes 251 may be perpendicular to the extending directions of the beam elements 210 and 220 where the second receiving holes 251 are located. For example, the longitudinal directions of the second receiving holes 251 located over the first beam element 210 may be perpendicular to the extending direction of the first beam elements 210 (i.e., the first direction D1). When the four second receiving holes 251 are formed in the beam element bracket 250, two second receiving holes may be arranged along the first directions D1, and remaining two second receiving holes may be arranged along the second directions D2.

Each of the second receiving holes 251 has a second circular portion 251*a* and a second elliptical portion 251*b*. The second circular portion 251*a* has a circular shape, and the second elliptical portion 251*b* has an elliptical shape. In some embodiments, the second circular portion 251*a* and the second elliptical portion 251*b* may be concentrically formed.

The pedestal 240 and the beam element bracket 250 are coupled to each other through the first receiving holes 247 of the pedestal 240 and the second receiving holes 251 of the beam element bracket 250.

The coupling pin 253 protrudes from the lower surface of the beam element bracket 250 to have a pin shape. The coupling pin 253 may be provided as multiple coupling pins 253. In this case, each pair of the coupling pins 253 are symmetrically arranged with respect to each of the second receiving holes 251. The coupling pins 253 are inserted into the respective upper holes 215 and 225 of the beam elements 210 and 220 to prevent the beam element bracket 250 from being separated from the beam elements 210 and 220.

The seat portion 255 extends from the lower surface of the beam element bracket 250. In some embodiments, seat portions 255 may extend downward in a vertical direction of the lower surface of the beam element bracket 250 along the circumference of the lower surface. When the beam element bracket 250 is viewed from the side, the seat portions 255 have a U-shape.

A groove 257 is formed between each of the seat portions 255, and the body portions 211 and 221 of the beam elements 210 and 220 are coupled to the respective grooves 257. That is, the seat portions 255 prevent the beam element bracket 250 from being separated from the beam elements 210 and 220 after the beam element bracket 250 is seated on the beam elements 210 and 220.

Figure 9:
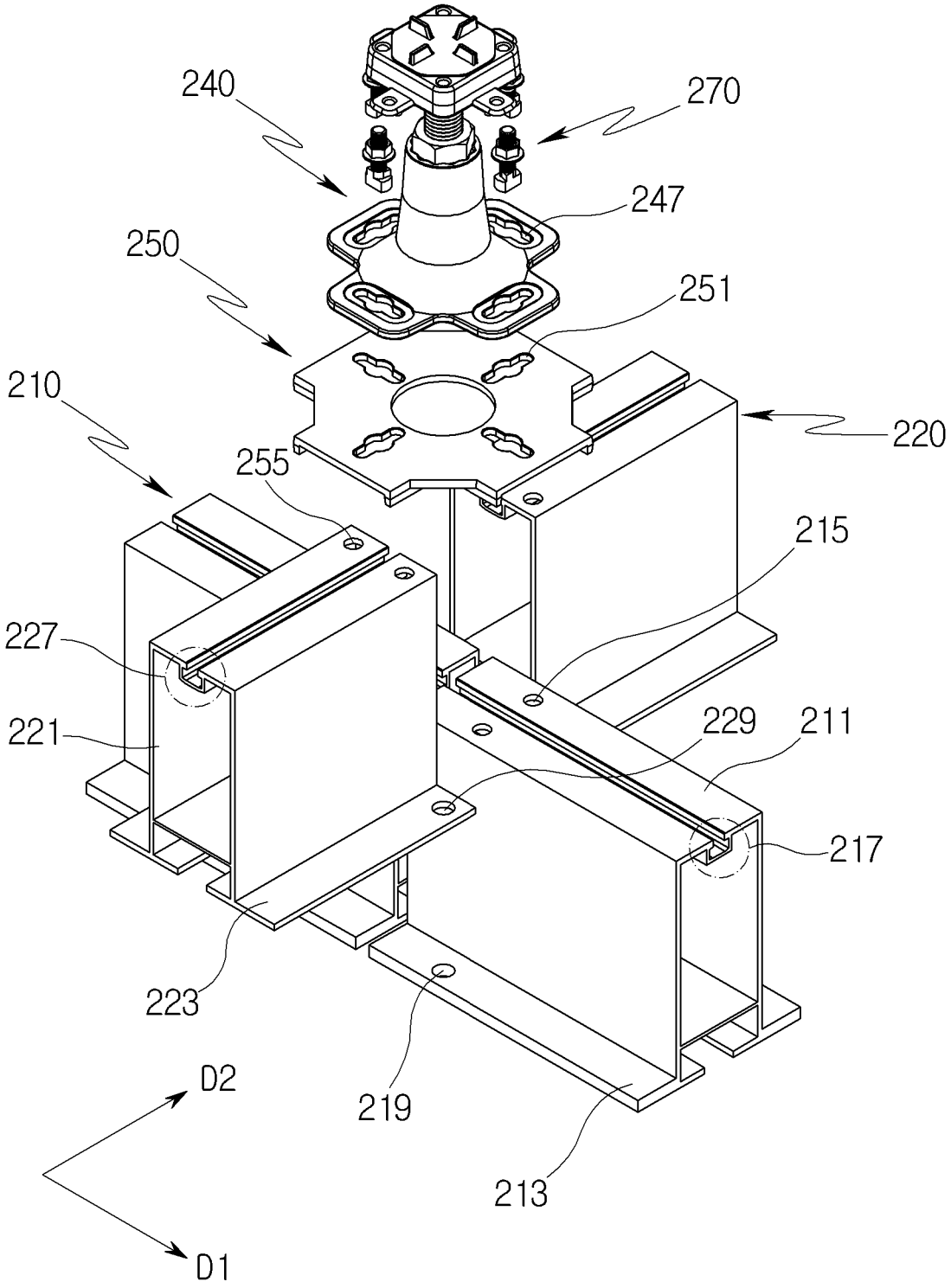
FIG. 9 is a view showing a process of assembling the pedestal and the beam elements according to embodiments of the present invention.

FIG. 9 shows beam elements, a pedestal, and a beam element bracket according to embodiments of the present invention. Referring to FIGS. 1 to 9, the second wings 223 of the second beam elements 220 are seated on the first wings 213 of the first beam elements 210. Herein, the second wings 223 are seated on the first wings 213 such that the first lower holes 219 and the second lower holes 229 are aligned with each other. Beam element coupling bolts are passed through the first lower holes 219 and the second lower holes 229 to couple the first wings 213 and the second wings 223 to each other. When the first wings 213 and the second wings 223 are coupled to each other, the heights of the upper surfaces of the first beam elements 210 and the second beam elements 220 become the same.

The beam element bracket 250 is seated on the upper surfaces of the first beam elements 210 and the second beam elements 220. Herein, the beam element bracket 250 is seated such that the coupling pins 253 of the beam element bracket 250 are inserted into the respective upper holes 215 and 225 of the beam elements 210 and 220, and the seat portions 255 of the beam element bracket 250 are seated on the respective body portions 211 and 221.

The pedestal 240 is seated on the beam element bracket 250. In some embodiments, the pedestal 240 may be seated such that the first receiving holes 247 correspond one to one to the second receiving holes 251. For example, the pedestal 240 may be seated on the beam element bracket 250 such that the first receiving holes 247 partially overlap with the second receiving holes 251.

In some embodiments, the pedestal 240 is seated on the beam element bracket 250 such that the first circular portions 247*a* of the pedestal 240 and the second circular portions 251*a* of the beam element bracket 250 are concentrically arranged. As described above, the longitudinal directions of the first receiving holes 247 (i.e., the directions having the longest length) and the longitudinal directions of the second receiving holes 251 may be perpendicular to each other.

The pedestal 240 and the beam element bracket 250 are fixed to the beam elements 210 and 220 through pedestal connection portions 270. The pedestal connection portions 270 are fixed to the beam elements 210 and 220 by being passed through the pedestal 240 and the beam element bracket 250. In some embodiments, the pedestal connection portions 270 may be passed through the first circular portions 247*a* of the pedestal 240, passed through the second circular portions 251*a* of the beam element bracket 250, and inserted into the slide grooves 217 and 227 of the beam elements 210 and 220.

Through the pedestal connection portions 270 that are passed through the first receiving holes 247 of the pedestal 240 and the second receiving holes 251 of the beam element bracket 250, the pedestal 240 is seated on the beam element bracket 250.

Each of the pedestal connection portions 270 may be a T-bolt having a T-shaped head. In some embodiments, the length (i.e., the largest diameter) of the T-shaped head of the pedestal connection portion 270 may be equal to or less than the diameter of each of the first circular portions 247*a* and the diameter of each of the second circular portions 251*a*, but is not limited thereto.

Figure 10:
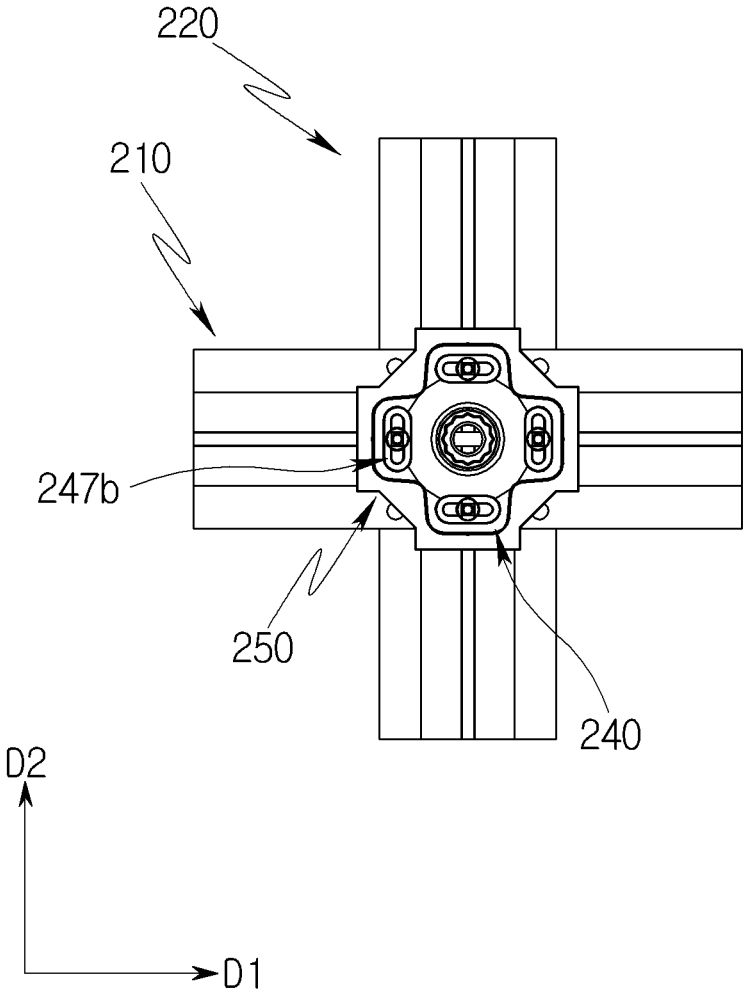
FIGS. 10 to 12 are views showing movement of the pedestal according to embodiments of the present invention.
Figure 11:
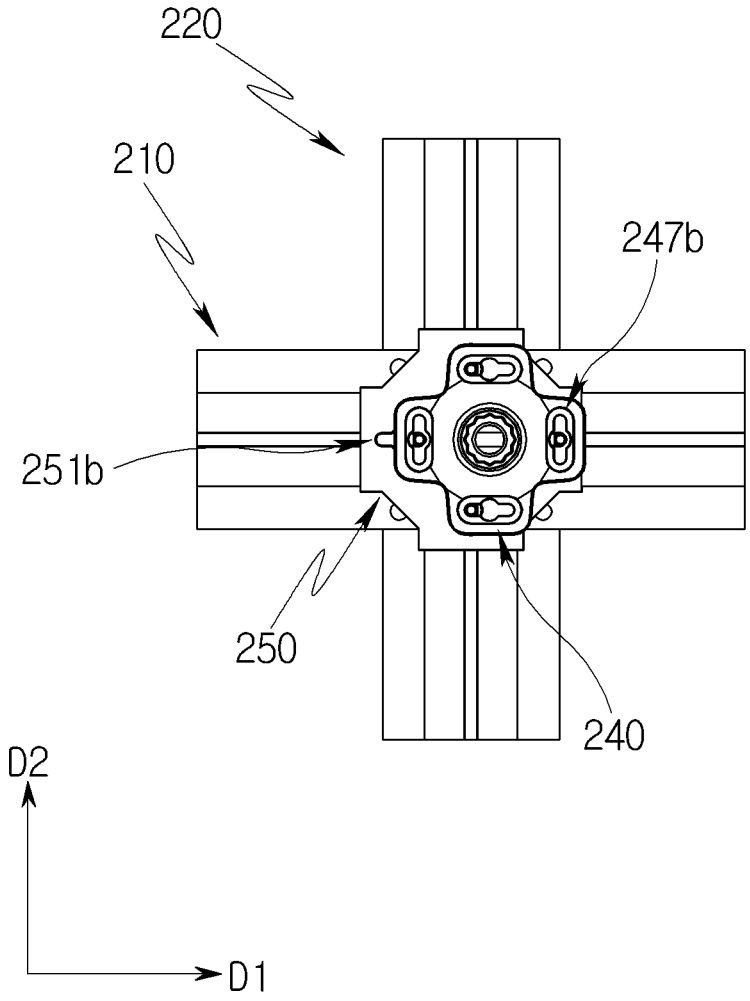
Figure 12:
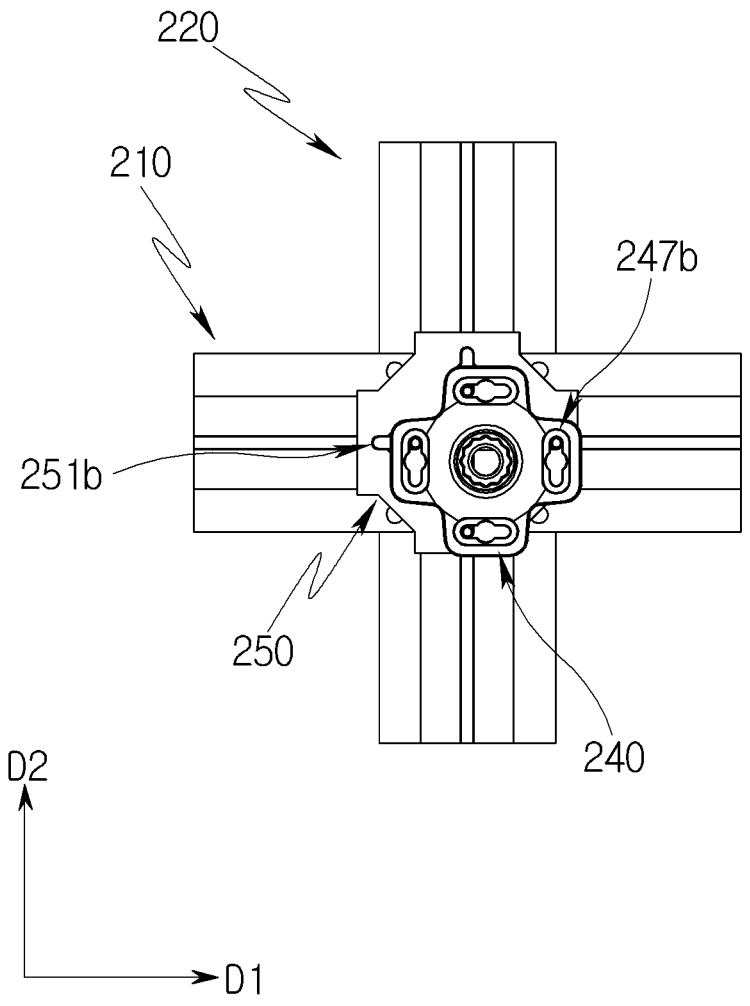

FIGS. 10 to 12 are views showing movement of the pedestal according to embodiments of the present invention. In FIGS. 10 to 12, the shapes of the first receiving holes 247 and the second receiving holes 251 are not shown, and thus additional reference will be made to FIG. 9. Referring to FIGS. 9 to 12, the pedestal connection portions 270 are received in the first receiving holes 247 and the second receiving holes 251. In some embodiments, the pedestal connection portions 270 may be received in the first elliptical portions 247*b* of the first receiving holes 247 and the second elliptical portions 251*b* of the second receiving holes 251. For example, the pedestal connection portions 270 may be received in the first elliptical portions 247*b* and the second elliptical portions 251*b* so as to be movable therebetween.

Thus, even after the pedestal connection portions 270 are passed through the pedestal 240 and the beam element bracket 250 and coupled to the beam elements 210 and 220, the pedestal connection portions 270 is movable back and forth and side to side through the first elliptical portions 247*b* of the pedestal 240 and the second elliptical portions 251*b* of the beam element bracket 250. This therefore ensures that a horizontal position of the pedestal 240 on the beam element bracket 250 is controlled.

As shown in FIG. 10, a position of the pedestal 240 when the pedestal connection portions 270 are received in central portions of the first receiving holes 247 and central portions of the second receiving holes 251 may be referred to as a reference position. For example, the pedestal connection portions 270 may be received in the first circular portions 247*a* and the second circular portions 251*a*, and in this case, a central point of the pedestal 240 and an intersecting point of the beam elements 210 and 220 may coincide with each other. The pedestal 240 according to the embodiments of the present invention is movable back and forth and side to side from the reference position.

As shown in FIG. 11, the pedestal connection portions 270 are movable along the second elliptical portions 251*b* in the second directions D2, causing the pedestal 240 to be moved in the second direction D2 and seated on the beam element bracket 250. Furthermore, as shown in FIG. 12, the pedestal connection portions 270 are movable along the first elliptical portions 247*b* in the first directions D1, causing the pedestal 240 to be moved in the first direction D1 and seated on the beam element bracket 250.

Although not shown in FIGS. 11 and 12, the pedestal connection portions 270 are movable along the second elliptical portions 251*b* in the second directions D2 and are movable along the first elliptical portions 247*b* in the first directions D1. This causes the pedestal 240 to be moved in the first direction D1 and the second direction D2 and seated on the beam element bracket 250.

According to the embodiments of the present invention, there is an advantage in that the pedestal 240 to be seated on the beam element bracket 250 is moved back and forth and side to side in conjunction with the movement of the pedestal connection portions 270 that connect the pedestal 240 and the beam element bracket 250 to each other. Accordingly, even when the center of the pedestal 240 is not located at the intersecting point of the unit panels 110 due to installation accumulated tolerances or other construction reasons, this can be solved by easily moving the position of the pedestal 240.

Furthermore, due to the fact that the support structure 200 according to the embodiments of the present invention includes the height-adjustable pedestal 240, there is an advantage of efficiently adjusting the distance between the support structure 200 and the floor panel 100.

Furthermore, according to the embodiments of the present invention, due to the fact that the pedestal 240 and the beam element bracket 250 are coupled to the beam elements 210 and 220 using the pedestal connection portions 270, there is an advantage in that the support structure 200 is increased in stability. Furthermore, according to the embodiments of the present invention, due to the fact that the pedestal connection portions 270 are inserted into the slide grooves 217 and 227 formed in the beam elements 210 and 220, there is an advantage in that the pedestal 240 is easy to mount without requiring provision of separate threads formed on the beam elements 210 and 220, thus simplifying a manufacturing process.

Although the exemplary embodiments of the present invention have been described for illustrative purposes, those skilled in the art will appreciate that various modifications, additions and substitutions are possible, without departing from the scope and spirit of the invention as disclosed in the accompanying claims. Accordingly, it should be understood that the present invention includes various modifications, additions and substitutions without departing from the scope and spirit of the invention as disclosed in the accompanying claims.

What is claimed is:

1. A support structure on which a floor panel is seated, and comprising:

a first beam element disposed in a first direction;

a second beam element disposed in a second direction perpendicular to the first direction;

a post supporting the first beam element and the second beam element;

a beam element bracket seated on top of the first beam element and the second beam element, and connecting the first beam element and the second beam element to each other; and a pedestal seated on top of the beam element bracket, and supporting the floor panel.

2. The support structure of claim 1, wherein the first beam element includes a first body portion, and a first wing protruding outward from the first body portion, the second beam element includes a second body portion, and a second wing protruding outward from the second body portion, and any one of the first wing and the second wing is seated on a remaining one of the first wing and the second wing.

3. The support structure of claim 2, wherein the first wing includes a first lower hole, the second wing includes a second lower hole, and the first wing and the second wing are connected to each other through a beam element connecting member inserted into the first lower hole and the second lower hole.

4. The support structure of claim 2, wherein the first body portion includes a first upper hole, the second body portion includes a second upper hole, and the beam element bracket includes coupling pins protruding from a lower surface of the beam element bracket, and being insertable into the first upper hole and the second upper hole.

5. The support structure of claim 1, wherein the beam element bracket includes a seat portion extending from the lower surface of the beam element bracket, and fixing the first beam element and the second beam element so as not to be separated from the beam element bracket.

6. The support structure of claim 1, wherein the pedestal includes:

a base portion seated on top of the beam element bracket;

a head portion supporting the floor panel; and a connection portion inserted into the base portion and the head portion, and including a height-adjustable thread.

7. The support structure of claim 6, further comprising:

a pedestal connection portion passing through the beam element bracket and the base portion, and coupled to the first beam element to connect the pedestal, the beam element bracket, and the first beam element to each other.

8. The support structure of claim 7, wherein the pedestal connection portion is a T-bolt having a T-shaped head.

9. The support structure of claim 7, wherein the base portion includes a first receiving hole receiving the pedestal connection portion, the beam element bracket includes a second receiving hole receiving the pedestal connection portion, and the pedestal connection portion connects the pedestal and the beam element bracket to each other by passing through the first and second receiving holes.

10. The support structure of claim 9, wherein the first receiving hole includes a first circular portion and a first elliptical portion, a diameter of the first circular portion is equal to or greater than a length of the head of the pedestal connection portion, and the pedestal connection portion is movable along the first elliptical portion such that the pedestal is horizontally movable on the beam element bracket.

11. The support structure of claim 9, wherein the first beam element includes a first slide groove receiving the pedestal connection portion, and the pedestal connection portion is inserted into the first slide groove by passing through the first and second receiving holes.

12. The support structure of claim 6, wherein the head portion includes a seat guide portion protruding from an upper surface of the head portion by a predetermined thickness, and fixing the floor panel.

13. The support structure of claim 1, further comprising:

stringers connected to the pedestal and extending in the first direction and the second direction, wherein the stringers support the floor panel together with the pedestal.

14. An access floor system, comprising:

a floor panel; and a support structure supporting the floor panel, wherein the floor panel includes multiple unit panels, and the support structure includes:

a first beam element disposed in a first direction;

a second beam element disposed in a second direction perpendicular to the first direction;

a post supporting the first beam element and the second beam element;

a beam element bracket seated on top of the first beam element and the second beam element, and connecting the first beam element and the second beam element to each other; and a pedestal seated on top of the beam element bracket and supporting the unit panels.

15. The access floor system of claim 14, wherein the pedestal includes:

a base portion seated on top of the beam element bracket;

a head portion supporting the floor panel; and a connection portion inserted into the base portion and the head portion, and including a height-adjustable thread.

16. The access floor system of claim 15, further comprising:

a pedestal connection portion passing through the beam element bracket and the base portion, and coupled to the first beam element to connect the pedestal, the beam element bracket, and the first beam element to each other.

17. The access floor system of claim 16, wherein the base portion includes a first receiving hole receiving the pedestal connection portion, the beam element bracket includes a second receiving hole receiving the pedestal connection portion, and the pedestal connection portion connects the pedestal and the beam element bracket to each other by passing through the first and second receiving holes.

* * * * *